US009682791B2

(12) United States Patent
Lorence et al.

(10) Patent No.: US 9,682,791 B2
(45) Date of Patent: Jun. 20, 2017

(54) COMPARTMENT CONTAINER INCLUDING A SECONDARY RESERVOIR PACKAGE

(75) Inventors: Matthew W. Lorence, Plymouth, MN (US); David A. Kirk, Coon Rapids, MN (US); Scott Kackman, New Hope, MN (US); Diane Phillips, Fridley, MN (US)

(73) Assignee: General Mills, Inc., Minneapolis, MN (US)

( * ) Notice: Subject to any disclaimer, the term of this patent is extended or adjusted under 35 U.S.C. 154(b) by 949 days.

(21) Appl. No.: 13/105,207

(22) Filed: May 11, 2011

(65) Prior Publication Data

US 2011/0280998 A1 Nov. 17, 2011
US 2012/0258211 A9 Oct. 11, 2012

Related U.S. Application Data

(60) Provisional application No. 61/333,402, filed on May 11, 2010, provisional application No. 61/334,743, filed on May 14, 2010.

(51) Int. Cl.
*B65D 3/26* (2006.01)
*B65D 81/32* (2006.01)

(52) U.S. Cl.
CPC ..... *B65D 3/267* (2013.01); *B65D 81/3233* (2013.01)

(58) Field of Classification Search
CPC .... B65D 81/3216; B65D 85/36; B65D 15/06; B65D 3/24; B65D 3/04; B65D 81/3233; B65D 81/3288; B65D 81/3205; Y10S 206/83; A21D 10/025
USPC ..... 426/111, 106, 112, 115, 118, 120, 128, 426/122, 123; 229/120.32, 4.5; 220/505, 220/240, 504, 231, 281
See application file for complete search history.

(56) References Cited

U.S. PATENT DOCUMENTS

| | | | | |
|---|---|---|---|---|
| 2,949,369 A | | 8/1960 | Zoeller et al. | |
| 3,015,429 A | * | 1/1962 | Morici | 229/120.37 |
| 3,182,890 A | | 5/1965 | Elam | |
| 3,506,459 A | * | 4/1970 | Parlour | 426/111 |
| 3,851,757 A | * | 12/1974 | Turpin | 206/568 |
| 3,962,476 A | | 6/1976 | Turpin | |
| 4,093,073 A | * | 6/1978 | Leezer | B65D 3/22 206/830 |
| 4,114,784 A | * | 9/1978 | Hough et al. | 206/216 |
| 5,447,236 A | | 9/1995 | Perry et al. | |

(Continued)

FOREIGN PATENT DOCUMENTS

| | | |
|---|---|---|
| EP | 0 881 164 A2 | 12/1998 |
| EP | 1 048 575 | 11/2000 |

(Continued)

*Primary Examiner* — Viren Thakur
*Assistant Examiner* — Thanh H Nguyen
(74) *Attorney, Agent, or Firm* — John L. Crimmins, Esq.; Diederiks & Whitelaw, PLC

(57) ABSTRACT

The present invention relates to a compartment container that includes one or more secondary reservoir package(s). More specifically, the present invention relates to a tubular containers, such as containers made of composite material (e.g. paperboard) with end caps for packaging refrigerated dough products. The tubular containers house one or more reservoir package(s) that are formed from one or more flexible materials (e.g. polymeric films) and are used to retain condiments, fruits, icings, spices, nuts, candies or any other ancillary ingredient(s).

20 Claims, 6 Drawing Sheets

(56) References Cited

U.S. PATENT DOCUMENTS

| | | | | | |
|---|---|---|---|---|---|
| 5,749,460 | A * | 5/1998 | Rice | 220/23.83 | |
| 5,950,913 | A | 9/1999 | Rea et al. | | |
| 5,992,619 | A * | 11/1999 | Milano | B65D 75/32 | 206/216 |
| 6,085,942 | A * | 7/2000 | Redmond | B29C 51/08 | 206/469 |
| 6,116,500 | A | 9/2000 | Cahill | | |
| 6,152,355 | A * | 11/2000 | Morrow et al. | 229/4.5 | |
| 7,143,910 | B2 * | 12/2006 | Redmond | A45D 34/04 | 222/107 |

FOREIGN PATENT DOCUMENTS

| | | | |
|---|---|---|---|
| FR | 2 682 353 | A1 | 4/1993 |
| WO | WO 2008/019278 | A2 | 2/2008 |

* cited by examiner

COMPARTMENT CONTAINER INCLUDING A SECONDARY RESERVOIR PACKAGE

CROSS-REFERENCE TO RELATED APPLICATIONS

This application claims the benefit of priority under 35 U.S.C. 119(e)(1) or provisional patent application, Ser. No. 61/333,402, filed May 11, 2010 and provisional patent application, Ser. No. 61/334,743, filed May 13, 2010, which are incorporated herein by reference in its entity.

FIELD OF THE INVENTION

The present invention relates to a compartment container that includes one or more secondary reservoir package(s). More specifically, the present invention relates to tubular containers, such as containers made of composite material (e.g. paperboard) with end caps for packaging refrigerated dough products. The tubular containers house one or more reservoir package(s) that are formed from one or more polymeric films and are used to retain condiments, fruits, icings, spices, nuts, candies or any other ancillary ingredient(s).

BACKGROUND OF THE INVENTION

It is well-known to use an easy-open composite container for the packaging of raw, ready-to-bake, dough. In such a container, the container body, which is conventionally formed of a composite material (e.g. paperboard) is torn open by the consumer to expose the container contents so as to enable the removal of individual dough segments without substantial segment deformation. In some packaging of refrigerated dough products, containers including spirally wound composite materials having double seamed metal ends are used. It is sometimes desirable to include additional ingredients such as condiments, fruits, icing, spices, nuts, candies and the like, inside the container so that when the consumer opens the container to remove the refrigerated dough for baking, they will also have access to the additional ingredients.

In some packaging systems for refrigerated dough, it has been common practice to package icing in a pouch, place the icing in a paper sleeve and position the paper sleeve at one end of the refrigerated dough container and to have a loose metal separator between the dough and the icing pouch positioned in the paper sleeve. However, this type of packaging can produce problems in that the refrigerated dough in the container often excretes a fluid which can pass by the metal separator and penetrate the paper sleeve containing the icing pouch resulting in disintegration and crushing of the sleeve and ultimately in container failure. Also, the edge of the metal separator often cuts into the container liner allowing the fluid excreted from the dough to wet the body of the container and subsequently leading to reduced shelf life of the refrigerated dough package.

In other packaging systems, the topping or additional ingredients in such dough containers may be packed in a small open-ended plastic cup which, after being filled, is inserted, open end first, through an open end of the container body and pushed through the body until it seats against a closed end of the container. Such a container is disclosed in U.S. Pat. No. 3,182,890 to Elam. The plastic cup according toe Elam is provided with an annular flange adjacent its closed end that is adapted to engage the interior side-wall of the container tube and form a seal that prevents the dough from extruding into the space between the cup and the side-wall. Alternatively, an open ended plastic cup may be inserted, closed end first, into the open end of the container and pushed through the body to the bottom of the container. The open end of the cup may be sealed and/or covered with a metal separator that isolates the additional ingredients in the plastic cup from the dough that is subsequently placed in the container.

The dough in a dough container may generate substantial pressure within the closed container during storage of the packaged dough product. The dough undergoes certain chemical reactions and generates gas pressure in a process known as "proofing." To withstand such pressure, containers usually have metallic "ends" configured to engage an end portion of the paperboard body, either through a process of crimping or seaming. The crimped metal ends retain the dough despite significant force acting indirectly through the plastic cup, at one end, or directly on the metal end, at the other end.

Composite packages which are able to withstand internal pressures such as those generated by refrigerated dough products are generally able to withstand pressures in the range of 8 to 35 psi inside the container. A crimped meal end allows gases to vent until the dough product seals off the gas vent paths, and internal pressure then builds until an equilibrium pressure is reached. The metal ends and the can of conventional dough containers are designed to withstand this equilibrium pressure so that the package remains intact over the shelf life of the product.

SUMMARY OF THE INVENTION

The present invention relates to a compartment container that includes one or more secondary reservoir package(s). The present invention further includes methods of using the compartment containers of the present invention and the methods of making the containers and the secondary reservoir packages used to contain the additional and/or ancillary ingredients.

Various embodiments of the compartment container of the present invention include a container body having an interior side wall and one or more open end(s). The container body is normally sealed with one or more end closure(s) that are adapted to sealingly close the one or more open end(s) of the container body. The compartment container of the present invention also includes at least one ingredient reservoir. In many embodiments, the reservoir comprises a reservoir body formed from a flexible film and having a side wall including an open upper end and a lower end. The lower end is usually sealed to close the lower end of the reservoir body prior to filling with ancillary ingredients. The open end is normally adapted to be sealed following filling of the interior of the reservoir with one or more ancillary ingredient(s).

In some embodiments, the compartment container houses a product that is an expandable product. Upon sealing the container body, the pressure from the expandable product is exerted on the one or more reservoir(s) causing deformation of the reservoir(s) Such deformation of the reservoir(s) facilitates contact of the reservoir(s) film with the interior side wall of the container body. The deformation of the reservoir(s) due to the pressure from the expandable product will produce a seal between the interior side wall of the container body and the reservoir(s).

In some embodiments of the compartment containers of the present invention, the container body is substantially cylindrical having inner and outer diameters. Also, in various embodiments, the one or more reservoir(s) have a diameter slightly smaller than the inner diameter of the container, but large enough so that the reservoir(s) tightly fit within the container body when pressure from the expandable product is exerted on the reservoir(s). In yet other embodiments, the diameter of the reservoirs is slightly larger than the inner diameter of the container body, thereby allowing for a snug seal between the reservoir side wall and the inner wall of the container body when pressure from the expandable product is applied.

In various embodiments of the present invention, the compartment container includes reservoir(s) that are produced with a thin polymer film, such as polyester, nylons, polyolefins or any other suitable category of polymers (examples of specific polymers include polypropylene, polyethylene, polylactic acid, polyethylene terephthalate). Such reservoir(s) may include one or more reservoir cover(s) that close and seal the open end of the reservoir(s) once the ancillary ingredients have been inserted into the reservoir(s). In various embodiments, the film of one or more of the reservoir(s) may have a thickness of between about 1 and 15 mils.

As previously suggested, the compartment containers of the present invention may be filled with an expandable product (e.g. dough) and additional ancillary ingredients (e.g. icing, nuts, candies . . . ). Additionally, the reservoirs may include one or more tabs(s) that may be removed to dispense the additional ingredients contained within the reservoir(s).

The present invention also includes methods of packaging food products that include multiple ingredients. In various embodiments of present invention, a method of packaging food products with separated additional ingredients is taught wherein the following steps are performed:

providing a container body having an interior side wall and one or more open end(s);

inserting one or more ingredient reservoir(s) into the open end of the container body, each reservoir comprising a reservoir body formed of a flexible film including a side wall having an open upper end and a lower end that is adjoined to close the lower end of the reservoir body, the open end being adapted to be sealed following filling of the interior of the reservoir with one or more ancillary ingredients;

inserting a quantity of one or more expandable product(s) that fills the remainder of the container body; and sealing the container body with one or more end closure(s), whereby, once sealed, pressure from the product(s) in the container is exerted on the one or more reservoir(s) causing deformation of the reservoir(s) and further contact of the reservoir(s) film with the interior side wall of the cylindrical body to produce a seal between the interior side wall of the container body and the reservoir(s).

The foregoing and additional advantages and characterizing features of the present invention will become increasingly apparent to those of ordinary skill in the art by references to the following detailed description and to the drawings.

BRIEF DESCRIPTION OF THE DRAWINGS

The features and advantages of the present invention will become apparent from the following detailed description of a preferred embodiment of the invention, when taken in conjunction with the accompanying drawings, in which.

DETAILED DESCRIPTION OF THE INVENTION

The embodiments of the invention described below are not intended to be exhaustive or to limit the invention to the precise forms disclosed in the following detailed description. Rather, the embodiments are chosen and described so that others skilled in the art may appreciate and understand the components, principles and practices of the present invention.

Figure 1:
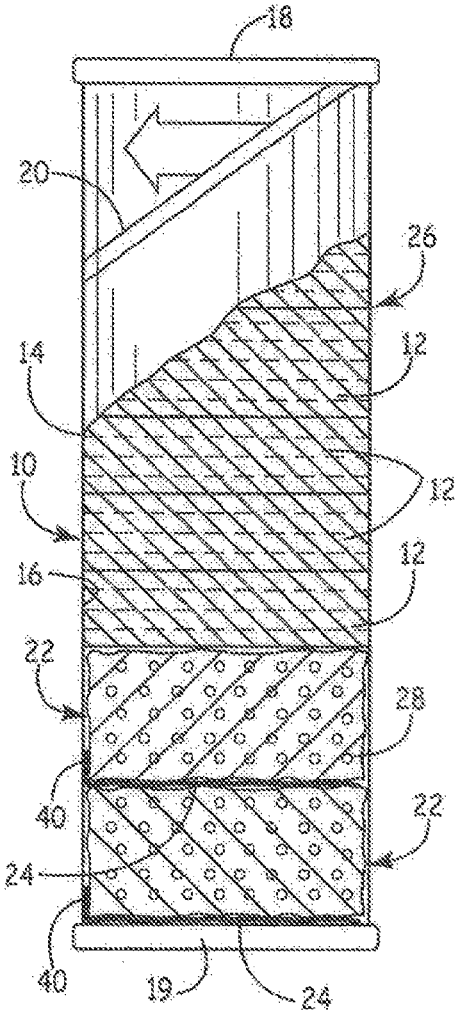
FIG. 1 is an elevational view, partially broken away and in section, of a compartment container having refrigerated dough or other expandable products therein and multiple stacked ingredient cups therein, which is constructed in accordance with the present invention.
Figure 2:
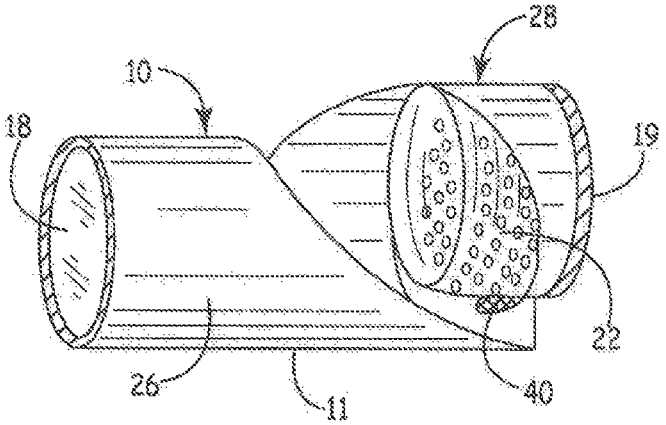
FIG. 2 is a perspective view of a compartment container, showing the manner in which the can is opened to provide ready and easy access to the contents of the compartments.

Referring now to FIG. 1 of the drawings, there is shown one embodiment of a container 10 of the present invention for refrigerated dough or other expandable products 12. The container 10 comprises an elongate substantially cylindrical body 14 having an interior wall 16 of a predetermined diameter. The container 10 further includes end closures 18. In one embodiment of the present invention the construction of the body 14 of the container 10 when used for refrigerated dough products 12 is a spirally-wound construction of composite material (e.g. laminar fiber board), typically including an inner liner layer of plastic and/or foil, multiple layers of thin paperboard, and an outer paper label layer. The sidewall 11 of the can is circumferentially dispartable along an elongated zone or line substantially at 20 as indicated in FIG. 2, which extends spirally around the container sidewall 11 and toward opposite ends thereof. To facilitate such circumferential disparting along such a zone or line 20, the can sidewall 11 may be constructed in any suitable manner such as that specifically set forth in application for U.S. Letters Patent Ser. No. 360,658, filed Jun. 10, 1953, William M. Geist, inventor, now abandoned, but it should be understood that the manner of providing for the circumferential disparting should not be limited to that shown in the identified application. These spirally-wound composite containers are well understood by those with ordinary skill in the art and a full explanation hereof is not deemed necessary for an understanding of this invention.

In various embodiments of the present invention the composite material used to form the cylindrical body 14 includes a paperboard material that has a barrier layer superimposed inside the paperboard layer. In some embodiments of the present invention, the paperboard layer may include a spiral-winding paperboard or board stock having a thickness of approximately 0.010 and 0.050 inch, in other embodiments between about 0.015 and 0.030 inch and in yet other embodiments about 0.018 and 0.025. The barrier liner layer may advantageously comprise a flexible material such as a polymer, a metalized polymer, a silicate impregnated polymer or a lamination of property enhancing polymers of polymer coatings on polymers, foils or paper, lamination of paper, metalized paper, silicate impregnated polymer or foil engineered in combination to achieve a good barrier between the paperboard and the expandable products.

Additionally, the container body 14 may take the form of a rigid body or a flexible body. Examples of rigid body containers include, but are not limited to, composite containers (e.g. convolute or spirally wound containers), plastic containers that may be produced by methods known in the art (e.g. blowmolding, injection molding, vacuum or thermo forming and the like), metal containers or any other container that has a rigid structure. Examples of flexible body containers include, but are not limited to, chubs, horizontal form filled packaging, vertical form filled packaging, horizontal wrap packaging, pre-made pouches and the like. It is noted that in various embodiments of the present invention, such as rigid or flexible containers, the body 14 may be formed of suitable materials, such as paperboard, plastics, metals, composite materials and the like. For examples, various plastics such as polyethylene terephthalate, high and low density polyethylene, polypropylene, polystyrene, polylactic acid or other plastic resins used for packaging food products.

In various embodiments of the present invention, the container 10 further includes end closures 18, 19 positioned at each end of the respective open ends of the cylindrical body 14 and secured to the container 10 with the expandable product 12 contained therein. The end closures 18, 19 may be made of metal or plastic ends that are seamed or crimped to the body portion 14, as shown in FIG. 1 and which is also well known to those with ordinary skill in the art. Other end closures and means to secure them to the cylindrical body 14 known in the art may be used to seal the two ends of the container 10.

The container 10 of the present invention further includes one or more flexible reservoirs 22 for the packaging and separation of ancillary ingredients. As seen in FIGS. 1 and 2 the container 10 includes two and one reservoirs 22, respectively. In some embodiments of the present invention, the reservoir(s) 22 include a reservoir body 24 and a reservoir cover 26; the film of a reservoir 22 adjacent and contacting the expandable products 12 generally operates to separate the container 10 into a first tubular portion 28 for containing dough or other expandable products 12 and a second tubular portion 30 for containing one or more reservoir(s) 22, which holds the ancillary ingredients.

Figure 3:
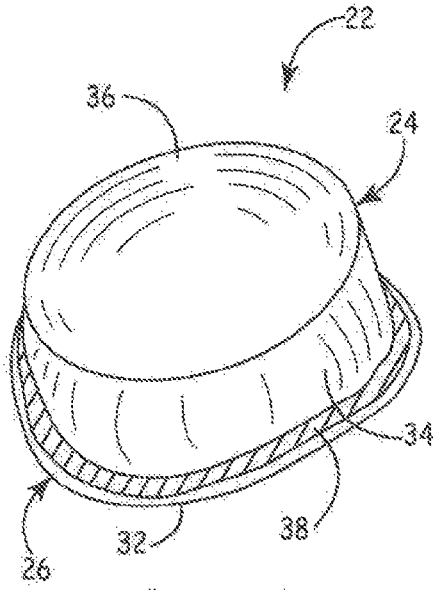
FIG. 3 is perspective view of one embodiment of the reservoir of the present invention.
Figure 4:
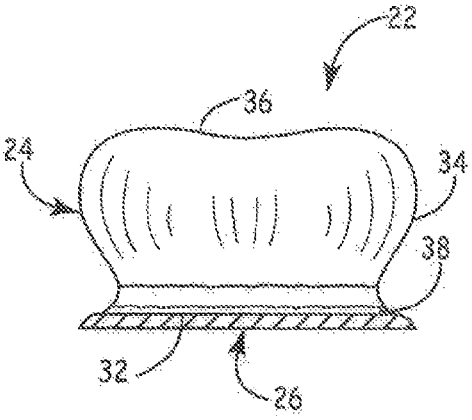
FIG. 4 is side view of the reservoir of FIG. 3.

FIGS. 3 and 4 depict a perspective view and a side view of one embodiment of a reservoir 22 of the present invention. This embodiment includes a reservoir body 24 comprising a first end 32 that is open for filling with ancillary ingredients, a reservoir side wall 34 and a bottom wall 36 that is closed to retain the ancillary ingredients upon filling. In some embodiments, the first end 32 may include a ridge 38 that provides a surface to seal the reservoir body 24 with the reservoir cover 26 by securing the ridge 38 to reservoir cover 26 with suitable fastener. Suitable fasteners that may be used to secure the film of the reservoir cover 26 and the ridge 38 include adhesives (e.g. ethylene vinyl acetate (EVA), polyethylene . . . ), heat welding, sonic welding, solvent welding or any other means that would secure the body 24 to the cover 26 so as to seal the ancillary ingredients into the reservoir 22.

Figure 5:
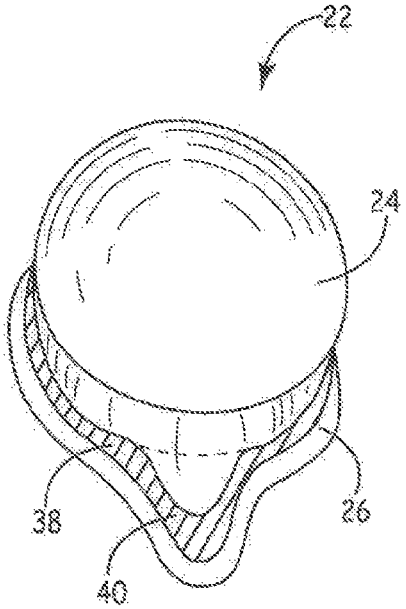
FIG. 5 is perspective view of one embodiment of the reservoir of the present invention the includes a tab.
Figure 6:
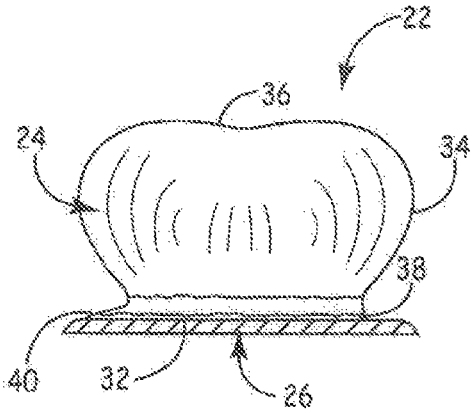
FIG. 6 is side view of the reservoir of FIG. 5.

FIGS. 5 and 6 depict a perspective view and side view of another embodiment of a reservoir 22 of the present invention. Similar to the embodiment of FIGS. 3 and 4, the reservoir 22 of this embodiment includes a reservoir body 24 having a ridge 38 that is secured to a reservoir cover 26. The reservoir 22 of this embodiment includes a tab 40 that includes a wide portion positioned adjacent to the reservoir side wall 34 that narrows as it extends away from the side wall 34. The tab 40 provides a beneficial function in allowing the user to remove and/or cut off the tab 40, thereby partially opening the reservoir 22 and allowing the ancillary ingredients to be dispensed or squeezed out of the reservoir body 24.

Generally, the reservoir body 24 and reservoir cover 26 is formed from a polymeric film. Examples of polymeric films include but are not limited to polyesters, nylons, polyolefins or any other suitable category of polymers. More specific examples include polypropylene, polyethylene, polylactic acid, polyethylene terephthalate or any other suitable film. In one embodiment of the present invention, a reservoir 22 comprises a reservoir body 24 having a film including Nylon, ethylene-vinyl alcohol and a polyethylene sealant (e.g. Curlon® 9531-S 2200 produced by Curwood Inc., Badger Avenue. P.O. Box 2968, Oshkosh, Wis. 54903-2968) and a reservoir cover 26 having a film including polyester, ethylene-vinyl alcohol and a ethylene-vinyl-acetate sealant (e.g. Curlam® 1835-G 2200 produced by Curwood Inc., Badger Avenue. P.O. Box 2968, Oshkosh, Wis. 54903-2968). Furthermore, the polymeric films used to produce the reservoir body 24 and cover 26 are generally thick enough to maintain stability from rupturing under pressure, but thin enough to easily form into a pocket for the containment of the ancillary ingredients. Various embodiments of the films are between about 1 and 15 mils, in other embodiments between about 1.5 and 10 mils, and yet other embodiments between about 2 and 7 mils.

In various embodiments of the present invention, the reservoir 22 generally has an outer diameter that is slightly smaller than the diameter of the inner wall 12 of the container body 14 such that the reservoir 22 produces a firm friction fit with the interior wall 16 upon pressure applied to the reservoir 22 and/or the reservoir cover 24 by the expandable product 12. However, in other embodiments of the present invention, the reservoir 22 is slightly larger in diameter than the interior wall 12 of the container body 14 or becomes slightly larger under pressure. In some embodiments the diameter of the reservoir as formed is 1" to 5" (e.g. 3⅛, the can inside diameter if 0.75" to 4¾" (e.g. 2⅞"). The slightly larger diameter of the reservoir(s) 22 ensures a tight seal to the interior wall 16 of the container 10, thereby preventing the expandable product 12 from undesirably expanding into gaps between the interior wall 16 of the container 10 and the body of the reservoir(s) 22.

The reservoirs of the present invention may be produced using various processes know in the art. For example, processes such as thermoforming, compression molding, transfer molding, blow molding or any other process that may be used to transform plastic resin into a formed thin film providing the desired reservoir body shape.

Figure 7:
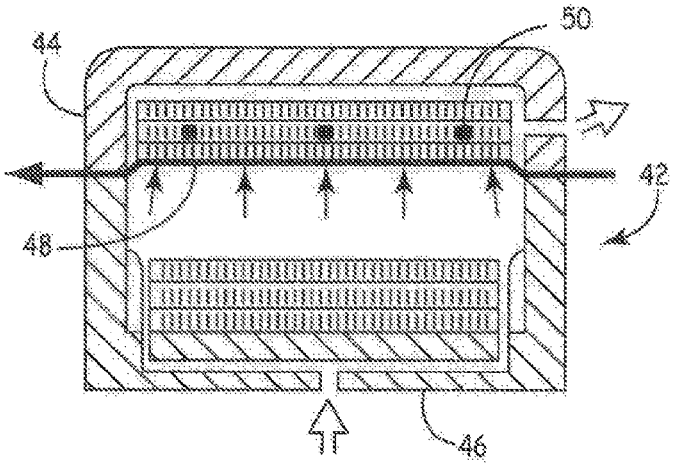
FIG. 7 is an elevational view, broken away and in section, of a thermoform mould shown in the film heating stage of the molding process that may be implemented in accordance with the present invention.
Figure 8:
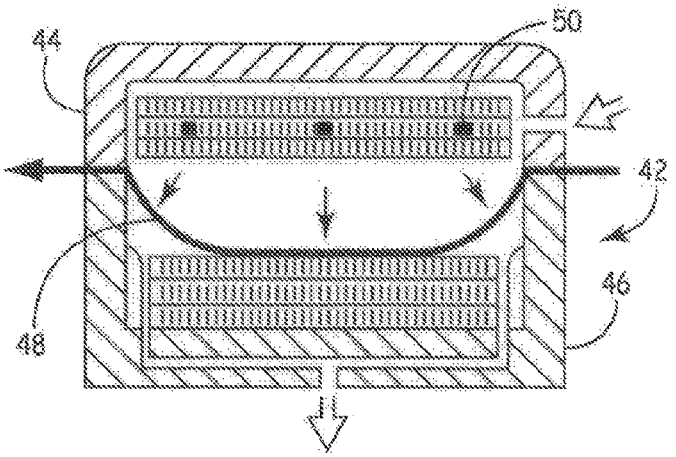
FIG. 8 is an elevational view, broken away and in section, of a thermoform mould shown in the air compression stage of the molding process that may be implemented in accordance with the present invention.
Figure 9:
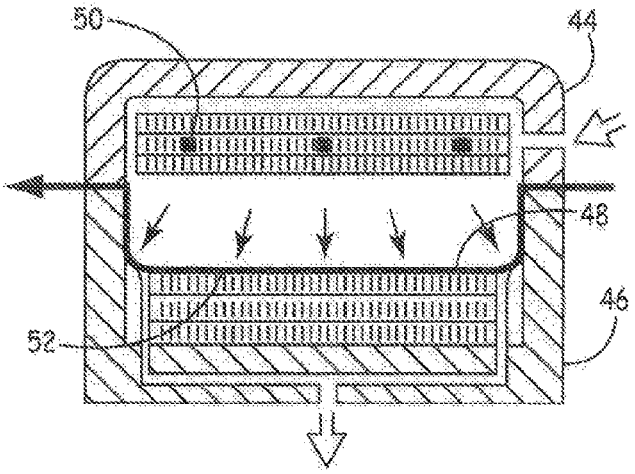
FIG. 9 is an elevational view, broken away and in section, of a thermoform mould shown in the film cooling stage of the molding process that may be implemented in accordance with the present invention.

FIGS. 7-9 depict one process used to form the reservoir body 24 of the reservoir(s) of the present invention. In such a process a thin plastic film (e.g. a film including Nylon, ethylene-vinyl alcohol and a polyethylene sealant) is positioned in a thermoform mould 42 that has been placed in a thermoform press (not shown). One type of press that may be used in the present application is a R140 Horizontal Form Fill Seal Packaging Machine produced by Multivac, Kansas City, Mo. As depicted in FIG. 7, a mould 42 having a top segment 44 and a bottom segment 46 is closed and compressed air presses a polymeric film 48 against a hot heating plate 50. The heating plate 50 applies heat to the film 48 until the film 48 becomes softened and formable. In some embodiments the forming temperature of the film 48 should be about 176° F. to 302° F. (80° C. to 150° C.), in other embodiments about 212° F. to 266° F. (100° C. to 130° C.), and in yet other embodiments about 239° F. to 257° F. (115° C. to 125° C.). Once heated to the proper forming temperature, the film is pushed into a mould having the desired shape (e.g. cylindrical, box . . . ) with compressed air as illustrated in FIG. 8. The film 48 comes in contact with the bottom segment 46 of the mould 42 as depicted in FIG. 9 and solidifies into the package pocket or reservoir body 24 as it comes into contact with the interior surface 52 of the mould 42 that has been cooled. Once the film has been cooled, the top and bottom segments 44, 46 are separated, thereby opening the mould 42 and the newly formed package pocket or reservoir body 24 is removed for trimming, if necessary.

Once the reservoir body 24 has been formed, the next step is to fill the body 24 with the auxiliary ingredients. This can be done by any means known in the art. As previously mentioned, one or more additional ingredients which may comprise a relatively dry topping or frosting material for biscuits and the like, is inserted into the bottom of the reservoir interior. Other additional ingredients include but are not limited to condiments, fruits, icings, spices, nuts, candies or any other ancillary ingredient(s). Once filled, the reservoir body 24 is sealed with a reservoir cover 26 by positioning the reservoir cover 26 over the open first end 32 and securing the cover 26 to the ridge 38 of the reservoir body 24 with one or more fasteners or fastener techniques. Vacuum may be used during the sealing process of the reservoir to reduce or eliminate the amount of air included in the chamber of the reservoir 22. The amount of vacuum will likely vary depending on the reservoir properties desired and the types of ingredients. In various embodiments of the present invention, the reservoirs are sealed at a pressure of between about 5 mbar and 1500 mbar and in other embodiments between about 200 mbar to 1000.

Figure 10:
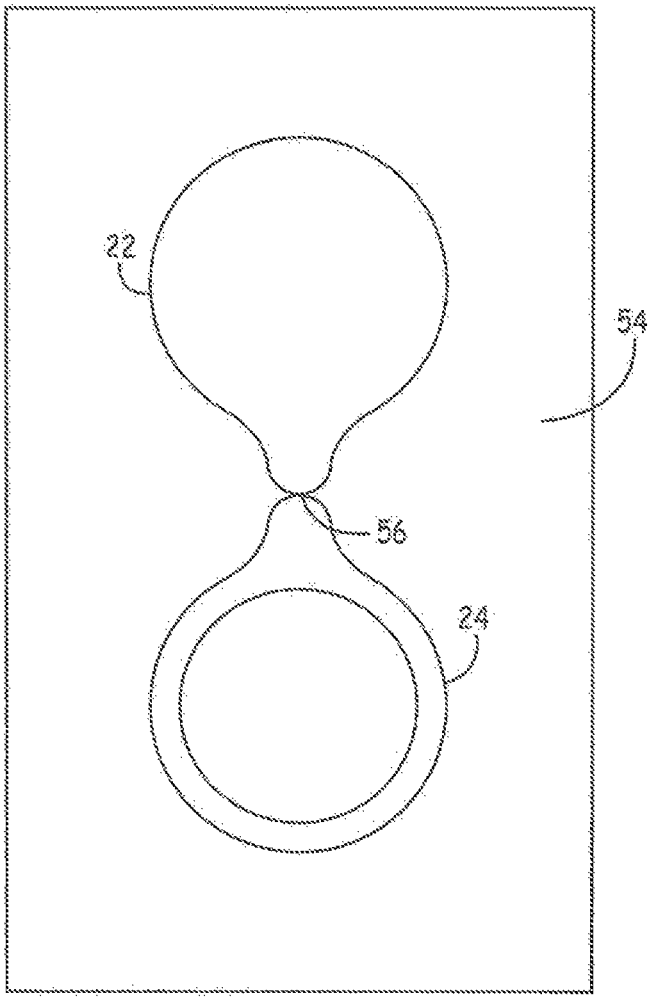
FIG. 10 is top view of one embodiment a film of the present invention that includes a unitary reservoir body and reservoir enclosure.

As depicted in FIG. 10, a reservoir 22 may be made from a single sheet 54 of film. In such an embodiment the reservoir body 24 is adjoined to the reservoir cover 26 at one or more connection points 56 on a single sheet of film. The filming of the body 24 may be performed as described above with the exception that the cover 26 is adjoined to the body 24. Once the body has been formed, the body 24 and cover 26 are separated from the sheet 54 and the cover is folded over the body 24 and secured with a fastener or fastening technique (e.g. heat welding, sonic welding, solvent welding . . . )

Figure 11:
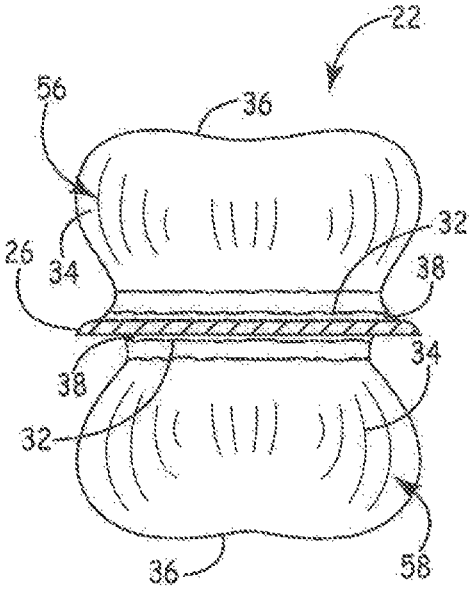
FIG. 11 is a side view of a reservoir that includes two reservoir bodies separated by a single reservoir enclosure.

Alternatively, multiple reservoirs may be included in a single unit. FIG. 11 depicts one embodiment of a reservoir 22 manufactured as a single unit. In some embodiments of the present invention, the reservoir 22 includes an upper reservoir body 56, a lower reservoir body 58 and a reservoir cover 26, which seals and separates the contents of each reservoir body, 56, 58. In various embodiments, the reservoir cover 26 is a single sheet of film, such as a plastic film. However, more than one sheet may be used to separate the two reservoir bodies, 56, 58.

Figure 12:
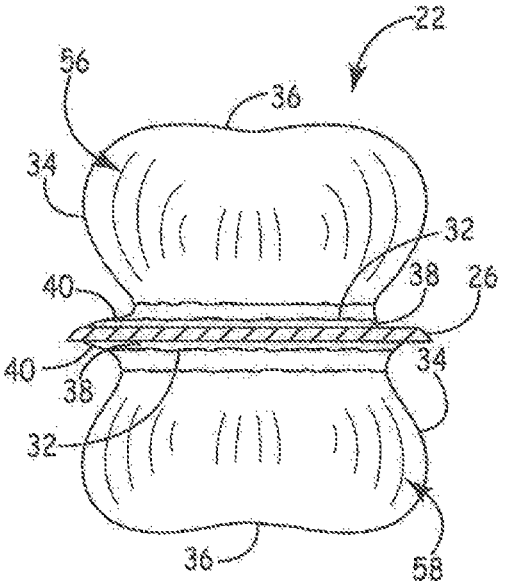
FIG. 12 is a side view of a reservoir that includes two reservoir bodies separated by a single reservoir enclosure and further including a tab.

FIGS. 11 and 12 depict side views of two embodiments of reservoirs 22 of the present invention that includes multiple reservoir bodies 56, 58. These embodiments include an upper reservoir body 56 and lower reservoir body 58, each reservoir body 56, 58 comprising a first end 32 that is open for filling with ancillary ingredients, a reservoir side wall 34 and a bottom wall 36 that is closed to retain the ancillary ingredients upon filling. In some embodiments, the first end 32 may include a ridge 38 that provides a surface to seal the reservoir body 24 with the reservoir cover 26 by securing the ridge 38 to reservoir cover 26 with suitable fastener. Suitable fasteners that may be sued to secure the film of the reservoir cover 26 and the ridge 38 include, but are not limited to, adhesives (e.g. ethylene vinyl acetate (EVA), polyethylene . . . ), heat welding, sonic welding, solvent welding or any other means that would secure the body 24 to the cover 26 so as to seal the ancillary ingredients into the reservoir 22.

FIG. 12 depicts a side view of another embodiment of a reservoir 22 of the present invention. Similar to the embodiment of FIG. 11, the reservoir 22 of this embodiment includes a multiple reservoir bodies 56, 58, each having a ridge 38 that is secured to a reservoir cover 26. The reservoir 22 of this embodiment includes two tabs 40, one tab 30 for each reservoir body 56, 58. Each tab 40 includes a wide portion positioned adjacent to the reservoir side wall 34 that narrows as it extends away from the side wall 34. The tabs 40 provide a beneficial function in allowing the user to remove and/or cut off the tab 40, thereby partially opening the reservoir 22 and allowing the ancillary ingredients to be dispensed or squeezed out of the reservoir body 24. It is noted that multiple tabs may be added to each reservoir body, thereby providing more than one opening for each reservoir body to dispense the ancillary ingredients.

With primary reference to FIGS. 1-6, one method to assemble the container 10 of the present invention is performed by first adjoining the bottom end closure 19 to the cylindrical body 14. Once the bottom end of the body 14 is sealed, one or more reservoir(S) 22 are placed into the open end of the body 14 and pushed until a surface of one reservoir 22 comes in contact with the bottom end closure 19. The reservoir(s) 22 are generally complimentary in shape and size in relation to the transverse configuration of the interior chamber defined by the container 10 sidewall 16. In some embodiments the reservoir(s) are placed in the container reservoir cover 26 down so that the bottom wall 36 of a reservoir contacts the expandable product(s) 12. It has been found that inserting the reservoir 22 in the container 10 cover side down promotes contact of the bottom wall 36 with the expandable product 12, thereby creating a very good seal inside the container. Such a seal does not allow for the formation of extrusion fingers of expandable product that may develop between gaps in the reservoir and the interior wall 16 of the body 14. It is noted that in insertion of the reservoir 22 cover side up has also been found to perform satisfactorily also. Once the reservoir(s) 22 are positioned at the bottom of the cylindrical body 14 an amount of extrudable product 12, such as dough, is inserted into the open end of the body 14 until the body 14 is full. Upon the completion of expandable product filling, the top of the cylindrical body is sealed with the top end closure 18. The sealing of the container with the top end closure 18 may be done by crimping, seaming, heat welding, sonic welding, clipping, banding, taping, sewing, solvent welding, adhesives or any other securing means known in the art.

In a number of embodiments of the present invention, the reservoir(s) 22 are configured to cooperate so that axial pressure exerted on the bottom wall 36 of the reservoir body 24 or the reservoir cover 26 by expanding dough or other expandable product 12 is transmitted to the film of the reservoir, thereby compressing and forcing the side wall 34, the bottom wall 36 or the reservoir cover 26 against the interior side of the cylindrical body 14. Such pressurized action creates a seal between the interior side wall of the body 14 and the side wall 34, bottom wall 36 or reservoir cover 26.

The reservoir(s) 22 are configured to stack bottom wall-against-reservoir cover so that axial load is transmitted through the side walls and so that the reservoirs are uniformly compressed by the pressure load from the expanding product 12. Thus, in a number of embodiments of the present invention, the side wall 34 is cylindrical such that the side wall 34 deforms uniformly upon compression by the expandable product 12.

After the expandable products 12 are sealed into the container 10, the pressure generated by the expanding of the expandable products 12 (e.g. leavening of dough) causes the expandable products 12 to press tightly against the inside walls of the body 14, the top enclosure 18 and the reservoir 22 thus increasing the effectiveness of the seal. The pressure of the expandable product also compresses the reservoir 22, thereby creating a seal between the film of the reservoir 22 and the inside wall 16 of the container 10. It is noted that the reservoir and the film must be able to withstand the pressure within the container that is created by the expandable products. For example the reservoir and the film that is used to form the reservoir must be able to withstand pressures in the range of about 2 to 75 psi without bursting or breaking; in other embodiments the reservoir and/or film must be able to withstand pressures in the range of about 8 to 35 psi without bursting or breaking.

Figure 13:
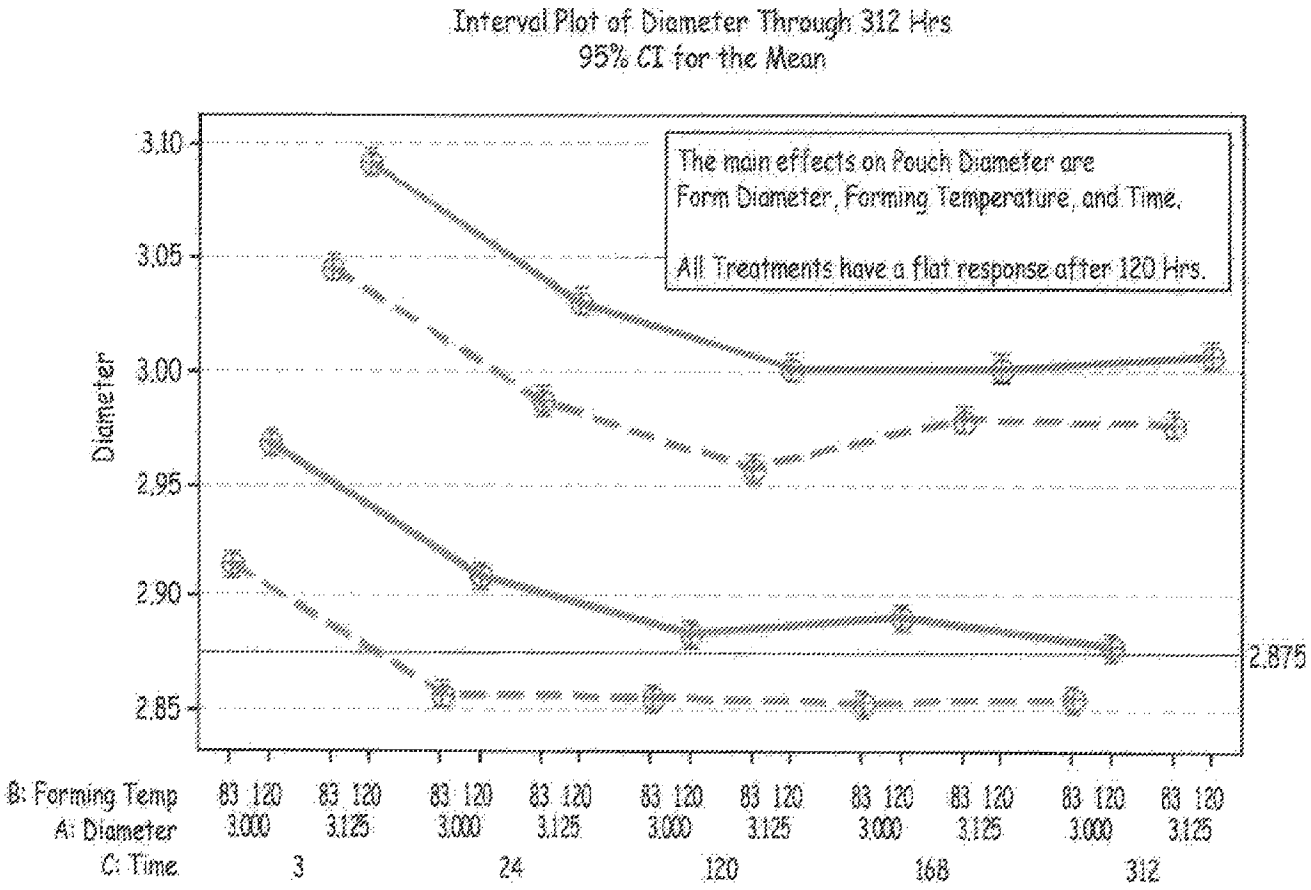
FIG. 13 is a chart illustrating the durability of a few embodiments of the reservoirs of the present invention.

FIG. 13 depicts a chart illustrating the durability of various embodiments of the reservoirs of the present invention. The chart illustrates the effect of initial form diameter, pouch forming temperature, and storage time on pouch diameter. Interval bars (the vertical bar at each point) are 95% confidence intervals. Interval bars that do not overlap are significantly different at the 95% confidence level. Each point represents the average value of 24 samples. In the tested embodiments, all of the main effects, initial form diameter, pouch forming temperature, and storage time had a significant effect on measured pouch diameter:

The magnitude of the effect of initial form diameter on measured pouch diameter is 0.12".

The magnitude of the effect of pouch forming temperature on measured pouch diameter is 0.04".

Most of the significant change in pouch diameter due to time is observed in the first 120 hours. The magnitude of the change in pouch diameter over the first 120 hours is 0.08". Little change in pouch diameter is observed after 120 hours.

In these embodiments of the present invention, it was concluded that both initial form diameter and pouch forming temperature are useful variable in controlling final pouch diameter and acceptability for use over time.

In the chart of FIG. 13:

Solid Lines show Pouches formed at a target temperature of 248° F. (120° C.).

Dashed Lines show pouches formed at a target temperature 181.4° F. (83° C.).

Green lines show pouches with an initial target diameter of 3.125 inches.

Red lines show pouches with an initial target diameter of 3.000 inches.

The minimum target diameter for pouch functionality (no dough extrusion observed around pouch) is 2.875".

Pouches formed at 181.4° F. (83° C.) on a 3.000 inch diameter form are clearly below the target line, and unacceptable.

Pouches formed at 248° F. (120° C.) on a 3.000 inch diameter form are on average just above the target line, but unacceptable due to variation in pouch diameter.

Pouches formed at 181.4° F. (83° C.) on a 3.125 inch diameter form are well above the target line, and acceptable.

Pouches formed at 247° F. (120° C.) on a 3.125 inch diameter form are well above the target line, and acceptable.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations, which fall within the spirit and broad scope of the invention.

The invention claimed is:

1. A compartment container comprising:

a container body having a side wall defining an upper end opening and a lower end opening; a food product contained within the container body;

an upper end closure positioned over the upper end opening of the container body and sealingly closing the upper end opening of the container body;

a lower end closure positioned over the lower end opening of the container body and sealingly closing the lower end opening; and at least one ingredient reservoir comprising a reservoir cover and a reservoir body, the reservoir body having a sidewall extending from a first end to a second end and comprising an end wall closing the second end of the reservoir body, wherein the first end of the sidewall includes a ridge providing a sealing surface and the reservoir cover is secured to the sealing surface of the ridge of the sidewall such that the at least one ingredient reservoir constitutes a sealed at least one ingredient reservoir, wherein the sealed at least one ingredient reservoir is positioned inside of the container body with the reservoir cover facing and extending across the container body directly adjacent the lower end closure, such that the food product contained within the container body is prevented from flowing past the ridge of the sidewall of the sealed at least one ingredient reservoir with a seal being created between the reservoir cover and the side wall of the container.

2. The compartment container of claim 1, wherein the sidewall of the sealed at least one ingredient reservoir is substantially cylindrical.

3. The compartment container of claim 1, wherein the at least one ingredient reservoir includes a tab that is configured to be removed to dispense ingredients contained within the reservoir, said tab extending directly between the sidewall of the reservoir body and the container body.

4. The compartment container of claim 1, wherein the container body includes a spirally-wound construction of one or more layers of composite material, an inner liner layer of plastic and/or foil and an outer paper label layer.

5. The compartment container of claim 1, wherein the container body is formed from one or more plastics.

6. The compartment container of claim 1, wherein the sidewall of the at least one ingredient reservoir is formed of a flexible film that includes one or more polymers.

7. The compartment container of claim 1, wherein the reservoir cover of the sealed at least one ingredient reservoir is in direct contact with the lower end closure inside the container body.

8. The compartment container of claim 1, wherein both the reservoir cover and the reservoir body are formed from a polymeric film.

9. The compartment container of claim 8, wherein the sidewall of the at least one ingredient reservoir is formed of a film having a thickness of between about 1 and 15 mils.

10. A compartment container comprising:

a container body having a side wall defining an upper end opening and a lower end opening; a food product contained within the container body;

an upper end closure positioned over the upper end opening of the container body and sealingly closing the upper end opening of the container body;

a lower end closure positioned over the lower end opening of the container body and sealingly closing the lower end opening; and at least one ingredient reservoir including a reservoir cover and a reservoir body, the reservoir body having a sidewall extending from a first end to a second end and including an end wall closing the second end of the reservoir body, wherein the sidewall of the at least one ingredient reservoir is formed of a film having a thickness of between about 1 and 15 mils such that the reservoir body constitutes a flexible pouch, the first end of the sidewall includes a ridge providing a sealing surface, the reservoir cover is secured and sealed to the sealing surface of the ridge of the sidewall, and the at least one ingredient reservoir is positioned inside of the container body with the reservoir cover facing the lower end closure, wherein the food product contained within the container body is prevented from flowing past the ridge of the sidewall of the at least one ingredient reservoir with a seal being created between the reservoir cover and the side wall of the container.

11. The compartment container of claim 10, wherein the food product is an expandable food product contained within the container body between the upper end closure and the sealed at least one ingredient reservoir, wherein pressure from the expandable product presses against the sealed at least one ingredient reservoir, causing deformation of the sealed at least one ingredient reservoir.

12. The compartment container of claim 11, wherein the deformation of the sealed at least one ingredient reservoir due to the pressure from the expandable product provides a seal between an interior of the side wall of the container body and the at least one ingredient reservoir.

13. The compartment container of claim 11, wherein the container body is substantially cylindrical having inner and outer diameters, and the sealed at least one ingredient reservoir has a diameter slightly larger than the inner diameter of the container body such that the sealed at least one ingredient reservoir fits tightly therein.

14. The compartment container of claim 11, wherein the container body is substantially cylindrical having inner and outer diameters, and the sealed at least one ingredient reservoir has a diameter slightly smaller than the inner diameter of the container, but large enough such that the sealed at least one reservoir fits tightly within the container body when pressure from the expandable product is exerted on the sealed at least one ingredient reservoir.

15. The compartment container of claim 10, wherein the thickness is between about 2 and 7 mils.

16. The compartment container of claim 10, wherein the at least one ingredient reservoir is sized relative to the container body such that the at least one ingredient reservoir frictionally fits within the container body.

17. The compartment container of claim 10, wherein the reservoir cover includes a tab configured to be removed to dispense ingredients contained within the reservoir body, said tab extending directly between the sidewall of the reservoir body and the container body.

18. A compartment container comprising:

a container body having a side wall defining an upper end opening and a lower end opening;

an upper end closure positioned over the upper end opening of the container body and sealingly closing the upper end opening of the container body;

a lower end closure positioned over the lower end opening of the container body and sealingly closing the lower end opening; and first and second ingredient reservoirs, wherein each of the first and second ingredient reservoirs includes a reservoir body having a sidewall extending from a first end to a second end, an end wall closing the second end of the reservoir body, a ridge providing a sealing surface at the first end of the sidewall, and a single reservoir cover secured to the sealing surface of the ridge at the first end of the sidewall of both of the reservoir bodies such that the single reservoir cover seals the reservoir body of both of the first and second ingredient reservoirs.

19. The compartment container of claim 18, where each of the first and second ingredient reservoirs frictionally fit within the container body.

20. The compartment container of claim 18, wherein each said reservoir body is formed from a polymeric film having a thickness of between about 1 and 15 mils.

* * * * *